US011721252B2

(12) United States Patent
Chiu et al.

(10) Patent No.: US 11,721,252 B2
(45) Date of Patent: Aug. 8, 2023

(54) CONTROL CIRCUIT AND DISPLAY DEVICE

(71) Applicant: Nuvoton Technology Corporation, Hsinchu Science Park (TW)

(72) Inventors: Ta-Chin Chiu, Hsinchu Science Park (TW); Tu-Yiin Chang, Hsinchu Science Park (TW); Wen-Yi Li, Jhonghe Dist. (TW)

(73) Assignee: NUVOTON TECHNOLOGY CORPORATION, Hsinchu Science Park (TW)

( * ) Notice: Subject to any disclaimer, the term of this patent is extended or adjusted under 35 U.S.C. 154(b) by 115 days.

(21) Appl. No.: 17/120,966

(22) Filed: Dec. 14, 2020

(65) Prior Publication Data

US 2021/0183285 A1 Jun. 17, 2021

(30) Foreign Application Priority Data

Dec. 16, 2019 (TW) ..... 108145916

(51) Int. Cl.
*G09G 3/00* (2006.01)
*G09G 3/36* (2006.01)

(52) U.S. Cl.
CPC ..... *G09G 3/006* (2013.01); *G09G 3/3696* (2013.01); *G09G 2330/12* (2013.01)

(58) Field of Classification Search
CPC .... G06F 21/6218; G06F 9/4881; G06F 9/468; G06F 9/50; G06F 9/5038
See application file for complete search history.

(56) References Cited

U.S. PATENT DOCUMENTS 9,711,106 B1 * 7/2017 Wang ..... G09G 3/006
10,777,121 B1 * 9/2020 Liao ..... G09G 3/2092
2010/0127628 A1 * 5/2010 Kunimori ..... H05B 45/12 315/159
2012/0098813 A1 * 4/2012 Park ..... G09G 3/3677 345/87

* cited by examiner

*Primary Examiner* — Michael A Faragalla
(74) *Attorney, Agent, or Firm* — Muncy, Geissler, Olds & Lowe, P.C.

(57) ABSTRACT

A control circuit driving a display panel and including a transmission interface, a charging circuit, an image driving circuit, and a loading management circuit is provided. The transmission interface is configured to be coupled to the display panel. The charging circuit is configured to charge a capacitor. The image driving circuit transforms the voltage of the capacitor into a plurality of driving signals and provides the driving signals to the display panel via the transmission interface. The loading management circuit measures the charge time of the capacitor. In response to the charge time of the capacitor exceeding a threshold value, the loading management circuit asserts a flag to indicate the occurrence of an overload.

20 Claims, 7 Drawing Sheets

CONTROL CIRCUIT AND DISPLAY DEVICE

CROSS REFERENCE TO RELATED APPLICATIONS

This application claims priority of Taiwan Patent Application No. 108145916, filed on Dec. 16, 2019, the entirety of which is incorporated by reference herein.

BACKGROUND OF THE INVENTION

Field of the Invention

The invention relates to a control circuit, and more particularly to a control circuit that is capable of driving a display panel.

Description of the Related Art

Generally, a display device may comprise a display panel and a control circuit. The control circuit is configured to generate an image signal. The display panel displays an image according to the image signal. During assembly of the display panel and the control circuit, if the display panel leaks liquid, a short-circuit may occur between the pins of the display panel. If the control circuit is abnormal, the display panel may display an abnormal image, or it may fail to display any image. When the display panel cannot display images normally, the tester cannot immediately know the cause of the abnormality of the display panel. The tester takes a lot of time to conduct his tests.

BRIEF SUMMARY OF THE INVENTION

In accordance with an embodiment of the disclosure, a control circuit drives a display panel and comprises a transmission interface, a charging circuit, an image driving circuit, and a loading management circuit. The transmission interface is configured to be coupled to the display panel. The charging circuit is configured to charge a capacitor. The image driving circuit transforms the voltage of the capacitor into a plurality of driving signals and provides the driving signals to the display panel via the transmission interface. The loading management circuit measures the charge time of the capacitor. In response to the charge time of the capacitor exceeding a threshold value, the loading management circuit asserts a flag to indicate the occurrence of an overload.

In accordance with another embodiment of the disclosure, a display device comprises a display panel, a capacitor, and a control circuit. The control circuit drives the display panel and comprises a transmission interface, a charging circuit, an image driving circuit, and a loading management circuit. The transmission interface is configured to be coupled to the display panel. The charging circuit is configured to charge the capacitor. The image driving circuit transforms the voltage of the capacitor into a plurality of driving signals and provides the driving signals to the display panel via the transmission interface. The loading management circuit measures the charge time of the capacitor. In response to the charge time of the capacitor exceeding a threshold value, the loading management circuit asserts a flag to indicate that an overload has occurred.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

Figure 1:
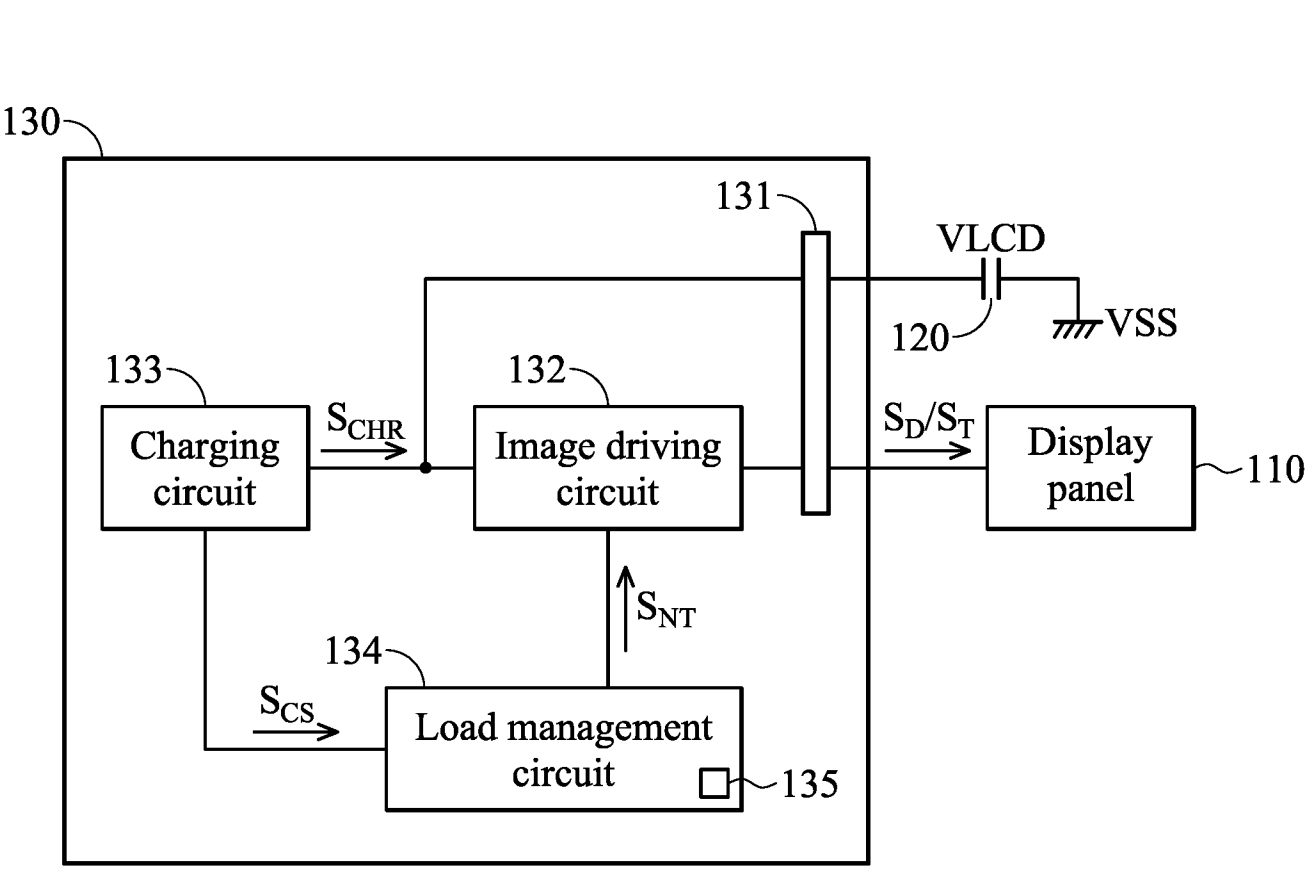
FIG. 1 is a schematic diagram of an exemplary embodiment of a display device, according to various aspects of the present disclosure.

The present invention will be described with respect to particular embodiments and with reference to certain drawings, but the invention is not limited thereto and is only limited by the claims. The drawings described are only schematic and are non-limiting. In the drawings, the size of some of the elements may be exaggerated for illustrative purposes and not drawn to scale. The dimensions and the relative dimensions do not correspond to actual dimensions in the practice of the invention.

FIG. 1 is a schematic diagram of an exemplary embodiment of a display device, according to various aspects of the present disclosure. As shown in FIG. 1, the display device 100 comprises a display panel 110, a capacitor 120, and a control circuit 130. The display panel 110 displays an image according to a driving signal $S_D$. The type of display panel 110 is not limited in the present disclosure. In one embodiment, the display panel 110 is a liquid crystal display (LCD) panel, such as a twisted nematic (TN) LCD panel or a super-twisted nematic (STN) LCD panel. In other embodiments, the display panel 110 is a passive matrix (PM) LCD panel.

The capacitor 120 is coupled to the control circuit 130 and disposed outside and independent of the control circuit 130, but the disclosure is not limited thereto. In one embodiment, the capacitor 120 is integrated into the control circuit 130. In this embodiment, the capacitor 120 provides a voltage VLCD to the control circuit 130 and receives a ground voltage VSS.

The control circuit 130 charges the capacitor 120 and uses the voltage VLCD provided by the capacitor 120 to generate the driving signal $S_D$. In one embodiment, the control circuit 130 serves as a microcontroller unit (MCU). In this embodiment, the control circuit 130 comprises a transmission interface 131, an image driving circuit 132, a charging circuit 133 and a load management circuit 134.

The transmission interface 131 is configured to couple to the display panel 110. In this embodiment, the transmission interface 131 is further coupled to the capacitor 120. The charging circuit 133 is configured to charge the capacitor 120. In one embodiment, when the voltage VLCD provided by the capacitor 120 is less than a target value, the charging circuit 133 provides a charging signal $S_{CHR}$ to the capacitor 120 via the transmission interface 131 to increase the voltage VLCD. In other embodiments, when the capacitor 120 is integrated into the control circuit 130, the charging circuit 133 provides the charging signal $S_{CHR}$ directly to the capacitor 120.

The image driving circuit 132 receives the voltage VLCD provided by the capacitor 120 and transforms the voltage VLCD provided by the capacitor 120 to the driving signal $S_D$. In this embodiment, the image driving circuit 132 provides the driving signal $S_D$ to the display panel 110 via the transmission interface 131. The type of image driving circuit 132 is not limited in the present disclosure. In one embodiment, the image driving circuit 132 is a common/segment (COM/SEG) driver.

The load management circuit 134 determines whether an over event occurs according to the charge time of the capacitor 120. The invention does not limit how the load management circuit 134 measures the charge time of the capacitor 120. In this embodiment, the load management circuit 134 determines whether the charge time of the capacitor 120 exceeds a threshold value based on a charge state signal $S_{CS}$ provided by the charging circuit 133. In such cases, when the charging circuit 133 charges the capacitor 120, the charging circuit 133 generates the charge state signal $S_{CS}$.

In one embodiment, the charge state signal $S_{CS}$ is the charging signal $S_{CHR}$. In such cases, the load management circuit 134 uses the number of pulses of the charging signal $S_{CHR}$ in a predetermined time (e.g., 1 sec) to obtain that the charge time of the capacitor 120 in the predetermined time. Therefore, when the number of pulses of the charging signal $S_{CHR}$ is large, this means that the charge time of the capacitor 120 is long. When the charge time of the capacitor 120 exceeds a threshold value, this means that the load of the display panel 110 is increased.

In other embodiments, the load management circuit 134 determines that the duration (e.g., 0.75 sec) of the charge state signal $S_{CS}$ being at a specific level (e.g., a high level) in a predetermined time (e.g., 1 sec). The charge time of the capacitor 120 is obtained according to the duration of the charge state signal $S_{CS}$ being at the specific level. In one embodiment, when the duration of the charge state signal $S_{CS}$ being at the specific level is long, this means that the loading of the display panel 110 is large.

When the charge time of the capacitor 120 does not exceed a threshold value, this means that there have been no overloads. Therefore, the load management circuit 134 continues to measure the charge time of the capacitor 120. However, when the charge time of the capacitor 120 exceeds the threshold value, it marks the occurrence of an overload. Therefore, the load management circuit 134 performs an overload operation. In one embodiment, the overload operation is to assert a flag 135, such as to write "1" to the flag 135. In such cases, when the flag 135 is not asserted, the value of the flag 135 is an initial value, such as "0".

The image driving circuit 132 determines whether to enter a test mode according to the value of the flag 135. For example, when the value of the flag 135 is "0", this means no overload. Therefore, the image driving circuit 132 operates in a normal mode. In the normal mode, the image driving circuit 132 continues to generate the driving signal $S_D$.

However, when the value of the flag 135 is "1", the image driving circuit 132 enters a test mode. In the test mode, the image driving circuit 132 generates a test signal $S_T$ and provides the test signal $S_T$ to the display panel 110 to find the cause of the overload. In one embodiment, the image driving circuit 132 transmits the test signal $S_T$ to the display panel 110 via at least one first pin of the transmission interface 131. In such cases, the load management circuit 134 determines whether the charge time of the capacitor 120 still exceeds the threshold value. If the charge time of the capacitor 120 does not exceed the threshold value, this means that the first pin did not cause the overload. Therefore, the image driving circuit 132 transmits the test signal $S_T$ to the display panel 110 via at least one second pin of the transmission interface 131. At this time, the load management circuit 134 determines whether the charge time of the capacitor 120 exceeds the threshold value. If the charge time of the capacitor 120 does not exceed the threshold value, this means that the second pin did not cause the overload. Therefore, the image driving circuit 132 transmits the test signal $S_T$ to the display panel 110 via at least one third pin of the transmission interface 131 until the charge time of the capacitor 120 exceeds the threshold value. However, when the second pin of the image driving circuit 132 transmits the test signal $S_T$, if the charge time of the capacitor 120 exceeds the threshold value, this means that the second pin caused the overload. Therefore, the load management circuit 134 records that results of testing show that the second pin is abnormal. The tester can quickly perform repairs according to the test result of the load management circuit 134.

In other embodiments, when an overload occurs, the load management circuit 134 generates a notification signal $S_{NT}$. The load management circuit 134 uses the notification signal $S_{NT}$ to direct the image driving circuit 132 to enter a test mode. In the test mode, the image driving circuit 132 sequentially uses each pin of the transmission interface 131 to transmit the test signal $S_T$ to find which pin caused the overload. In some embodiments, the image driving circuit 132 uses at least one first pin of the transmission interface 131 and other pins of the transmission interface 131 to transmit the test signal $S_T$ to the display panel 110. In such cases, if the charge time of the capacitor 120 does not exceed the threshold value, this means that there is no problem in the first pin. Therefore, the image driving circuit 132 does not use the second pin to transmit the test signal $S_T$ to the display panel 110. In one embodiment, the image driving circuit 132 may use a pin, other than the first pin and the second pin, to transmit the test signal $S_T$ to the display panel 110 or use a pin, other than the second pin, to transmit the test signal $S_T$ to the display panel 110. At this time, if the charge time of the capacitor 120 exceeds the threshold value, this means that the second pin has problems.

Figure 2:
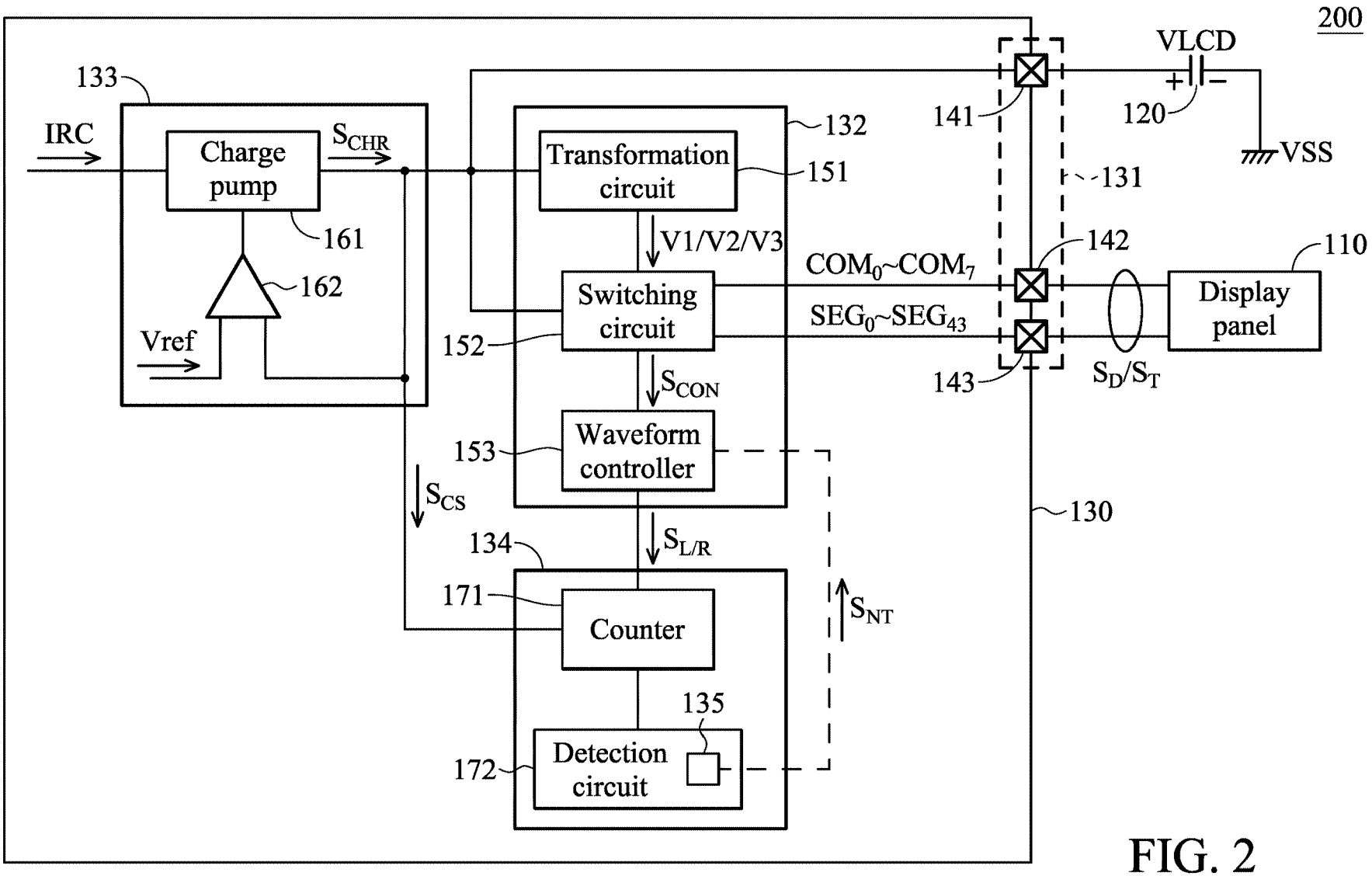
FIG. 2 is a schematic diagram of an exemplary embodiment of a control circuit, according to various aspects of the present disclosure.

FIG. 2 is a schematic diagram of an exemplary embodiment of a control circuit, according to various aspects of the present disclosure. In this embodiment, the transmission interface 131 has input-output pin groups 141~143. The input-output pin group 141 is configured to be coupled to the capacitor 120. In this embodiment, the input-output pin group 141 only has one pin. In other embodiments, when the capacitor 120 is combined in the control circuit 130, the input-output pin group 141 can be omitted.

The input-output pin groups 142 and 143 are coupled to the display panel 110. In this embodiment, the input-output pin group 142 has eight pins which transmit the common signals $COM_0$~$COM_7$, respectively. The input-output pin group 143 has forty-four pins to transmit the segment signals $SEG_0$~$SEG_{43}$. In this embodiment, the common signals $COM_0$~$COM_7$ and the segment signals $SEG_0$~$SEG_{43}$ form the driving signal $S_D$. The number of pins of the transmission interface 131 is not limited in the present disclosure. The number of pins of the transmission interface 131 relates to the number of common signals and the segment signals.

The charging circuit 133 detects the voltage VLCD provided by the capacitor 120. The charging circuit 133 charges the capacitor 120 when the voltage VLCD provided by the capacitor 120 is less than a target value Vref. In one embodiment, the charging circuit 133 provides the charging signal $S_{CHR}$ to the capacitor 120 via the input-output pin group 141 of the transmission interface 131 to increase the voltage VLCD provided by the capacitor 120. When the voltage VLCD provided by the capacitor 120 reaches the target value Vref, the charging circuit 133 charges the capacitor 120. In this embodiment, the charging circuit 133 comprises a charge pump 161 and a comparator circuit 162.

The comparator circuit 162 is configured to determine whether the voltage VLCD provided by the capacitor 120 is less than the target value Vref. When the voltage VLCD provided by the capacitor 120 is not less than the target value Vref, the comparator circuit 162 does not trigger the charge pump 161. However, when the voltage VLCD provided by the capacitor 120 is less than the target value Vref, the comparator circuit 162 triggers the charge pump 161.

When the pump 161 is triggered, the charge pump 161 generates the charging signal $S_{CHR}$ to charge the capacitor 120. In other embodiments, the charge pump 161 further receives a clock signal IRC. In such cases, the charge pump 161 generates the charging signal $S_{CHR}$ according to the clock signal IRC. The frequency of the clock signal IRC relates to the charging speed of the capacitor 120. For example, when the frequency of the clock signal IRC is high, the charging speed of the capacitor 120 charged by the charge pump 161 is fast. In one embodiment, the charge pump 161 directly uses the clock signal IRC as the charging signal $S_{CHR}$.

In this embodiment, the image driving circuit 132 is a COM/SEG driver to generate the common signals $COM_0$~$COM_7$ and the segment signals $SEG_0$~$SEG_{43}$. In such cases, the common signals $COM_0$~$COM_7$ and the segment signals $SEG_0$~$SEG_{43}$ constitute the driving signal $S_D$. The number of common signals and the number of segment signals are not limited in the present disclosure. The number of common signals and the number of segment signals relate to the structure of the display panel 110. In other embodiments, the image driving circuit 132 generates more or fewer common signals and segment signals.

The structure of image driving circuit 132 is not limited in the present disclosure. In one embodiment, the image driving circuit 132 comprises a transformation circuit 151, a switching circuit 152, and a waveform controller 153. The transformation circuit 151 transforms the voltage VLCD provided by the capacitor 120 to generate transformation voltages V1~V3. In other embodiments, the transformation circuit 151 may generate more or fewer transformation voltages. The structure of transformation circuit 151 is not limited in the present disclosure. In one embodiment, the transformation circuit 151 is a voltage divider circuit to divide the voltage VLCD.

The switching circuit 152 receives the voltage VLCD and adjusts the voltage levels of the common signals $COM_0$~$COM_7$ and the segment signals $SEG_0$~$SEG_{43}$ according to a control signal $S_{CON}$ so that the voltage levels of the common signals $COM_0$~$COM_7$ and the segment signals $SEG_0$~$SEG_{43}$ are changed between the transformation voltages V1~V3.

Figure 3:
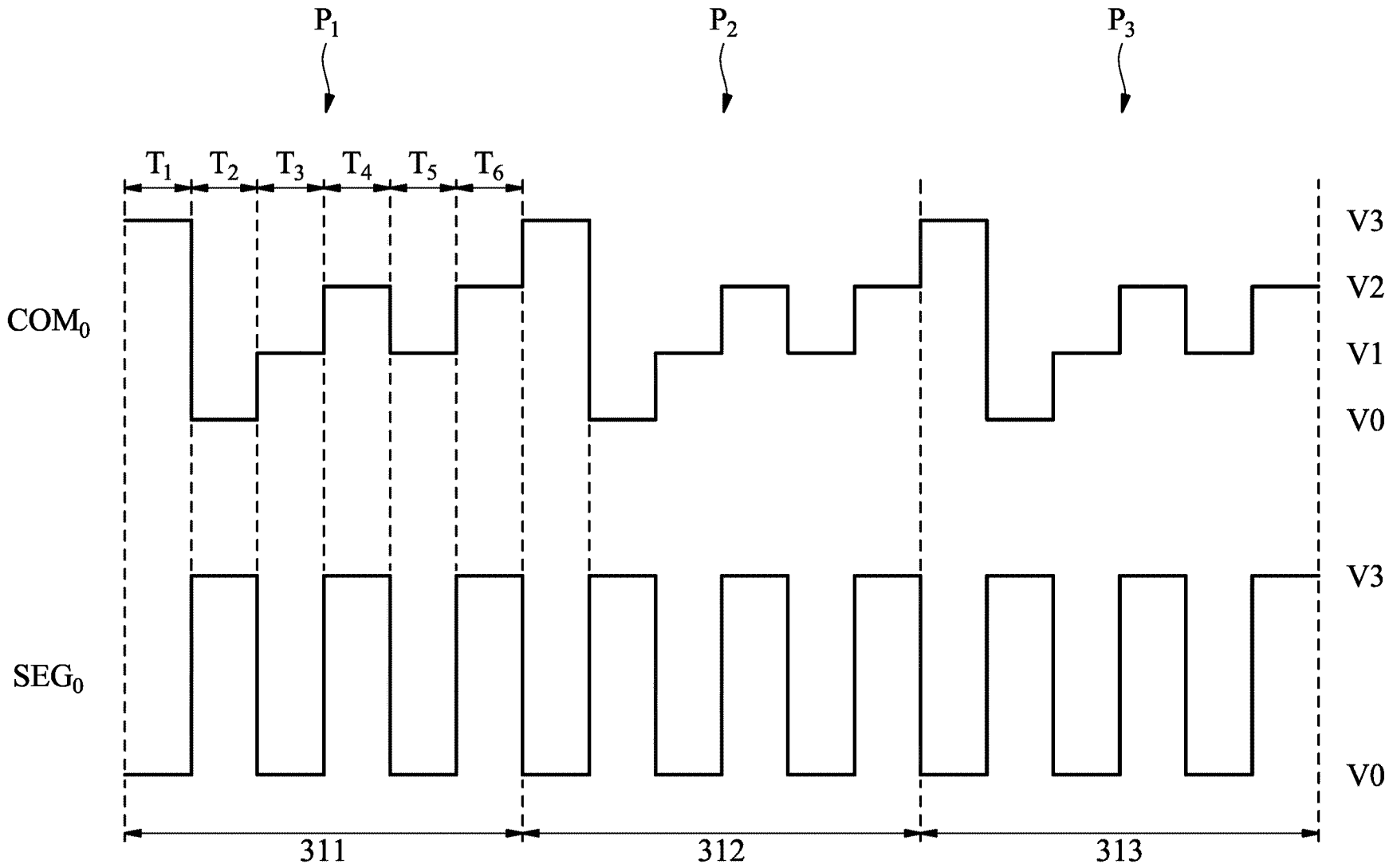
FIG. 3 is a schematic diagram of an exemplary embodiment of a common signal and a segment signal, according to various aspects of the present disclosure.

FIG. 3 is a schematic diagram of an exemplary embodiment of the common signal $COM_0$ and the segment signal $SEG_0$, according to various aspects of the present disclosure. Since the features of the common signals $COM_0$~$COM_7$ are the same, only the common signal $COM_0$ is shown in FIG. 3. Additionally, the features of the segment signals $SEG_0$~$SEG_{43}$ are the same, the segment signal $SEG_0$ is given as an example and shown in FIG. 3.

In this embodiment, the voltage of the common signal $COM_0$ changes between the voltages V0~V3, and the voltage of the segment signal $SEG_0$ changes between the transformation voltages V0 and V3, but the disclosure is not limited thereto. In other embodiments, the voltages of the common signal $COM_0$ and the segment signal $SEG_0$ may be changed among more voltages. In one embodiment, the voltage V0 is equal to the ground voltage VSS.

In period 311, the change of the voltage of the common signal $COM_0$ forms a pattern $P_1$. In period 312, the change of the voltage of the common signal $COM_0$ forms a pattern $P_2$. In period 313, the change of the voltage of the common signal $COM_0$ forms a pattern $P_3$. In this embodiment, the pattern $P_1$ is the same as each of the patterns $P_2$ and $P_3$. Furthermore, the duration of period 311 is the same as the duration of each of the periods 311 and 312. In this embodiment, the period 311 is adjacent to period 312, and period 312 is adjacent to period 313.

Since the changes of the voltages of the common signal $COM_0$ and the segment signal $SEG_0$ are the same in periods 311~313, period 311 is given as an example. As shown in FIG. 3, in period $T_1$, the common signal $COM_0$ is remained at the voltage V3, and the segment signal $SEG_0$ is remained at the voltage V0. In period $T_2$, the common signal $COM_0$ is remained at the voltage V0, and the segment signal $SEG_0$ is remained at the voltage V3. In period $T_3$, the common signal $COM_0$ is remained at the voltage V1, and the segment signal $SEG_0$ is remained at the voltage V0. In period $T_4$, the common signal $COM_0$ is remained at the voltage V2, and the segment signal $SEG_0$ is remained at the voltage V3. In period $T_5$, the common signal $COM_0$ is remained at the voltage V1, and the segment signal $SEG_0$ is remained at the voltage V0. In period $T_6$, the common signal $COM_0$ is remained at the voltage V2, and the segment signal $SEG_0$ is remained at the voltage V3.

In this embodiment, the durations of periods $T_1$~$T_6$ are the same. Additionally, the segment signal $SEG_0$ changes between voltages V0 and V3, but the disclosure is not limited thereto. In other embodiments, the segment signal $SEG_0$ may be changed between the voltages V0 and V1 or changed between the voltages V0 and V2.

Refer to FIG. 2, the load management circuit 134 determines whether the charge time of the capacitor 120 exceeds the threshold value based on the number of pulses of the charge state signal $S_{CS}$. In this embodiment, the charge state signal $S_{CS}$ is the charging signal $S_{CHR}$. In a predetermined time (e.g., 1 sec), if the number of pulses of the charging signal $S_{CHR}$ is larger than a predetermined number, this means that the charge time of the capacitor 120 exceeds the threshold value. Therefore, the load management circuit 134 generates the notification signal $S_{NT}$ to direct the image driving circuit 132 to enter a test mode. In other embodiments, when the number of pulses of charging signal $S_{CHR}$ is larger than the predetermined number, the load management circuit 134 asserts the flag 135.

In one embodiment, the predetermined time is the duration of period $T_1$ shown in FIG. 3. In another embodiment, the predetermined time is the duration of period 311 shown in FIG. 3. The invention does not limit how the load management circuit 134 counts the number of pulses of the charging signal $S_{CHR}$. In one embodiment, the load management circuit 134 comprises a counter 171 and a detection circuit 172.

The counter 171 executes a reset counting operation or a latch operation according to the control signal $S_{L/R}$. For example, when the control signal $S_{L/R}$ is at a first level (e.g., a high level), the counter 171 resets its counting value to an initial value and starts counting the number of pulses of the charging signal $S_{CHR}$. When the control signal $S_{L/R}$ is at a second level (e.g., a low level), the counter 171 latches the counting value to stop adjusting the counting value. For brevity, the counting value latched by the counter 171 is referred to as a latch value. In one embodiment, the control signal $S_{L/R}$ is generated by the waveform controller 152, but the disclosure is not limited thereto. In other embodiments, a control signal $S_{L/R}$ may be generated by the detection circuit 172.

The detection circuit 172 reads the latch value and compares the latch value with a threshold value. When the latch value exceeds the threshold value, this means that the charge time of the capacitor 120 is too long. Therefore, the detection circuit 172 uses the latch value as an abnormal value and performs an overload operation. The overload operation may send the notification signal $S_{NT}$ or assert the flag 135 to direct the image driving circuit 132 to enter the test mode.

In the test mode, the waveform controller 153 of the image driving circuit 132 uses the control signal $S_{CON}$ to control the switching circuit 152 to adjust the voltages of the common signals $COM_0$~$COM_7$ and the segment signals $SEG_0$~$SEG_{43}$. Then, the adjusted common signals and the segment signals are used as the test signal $S_T$ and provided to the display panel 110. The invention does not limit how the switching circuit 152 adjusts the common signals $COM_0$~$COM_7$ and the segment signals $SEG_0$~$SEG_{43}$. In one embodiment, the switching circuit 152 changes the voltage of the common signal $COM_0$ between the voltages V0~V3 and maintains the voltage of each of the common signals $COM_1$~$COM_7$ at a predetermined voltage (e.g., the voltage V0) or sets each of the common signals $COM_1$~$COM_7$ at a high impedance state. In such cases, the switching circuit 152 may change the segment signal $SEG_0$ between the voltages V0 and V3 and maintains the voltage of each of the segment signals $SEG_1$~$SEG_{43}$ at a predetermined voltage (e.g., the voltage V0) or sets each of the segment signals $SEG_0$~$SEG_{43}$ at a high impedance state. After the display panel 110 receives the test signal $S_T$, the charging circuit 133 generates the charging signal $S_{CHR}$ according to the voltage VLCD provided by the capacitor 120. The counter 171 counts the number of pulses of the charging signal $S_{CHR}$. When the control signal $S_{L/R}$ is at the second level, the counter 171 latches the counting value. To brevity, the counting value latched by the counter 171 is referred to as a first test value.

The detection circuit 172 compares the abnormal value with the first test value. When the first test value is less than the abnormal value, this means that no exceptional events have occurred in the pins transmitting the common signal $COM_0$ and the segment signal $SEG_0$. Therefore, the switching circuit 152 may not change the common signals $COM_1$~$COM_7$ and set the segment signals $SEG_0$ and $SEG_1$ to change between voltages V0 and V3. When the control signal $S_{L/R}$ is at the second level, the counter 171 latches the counting value. At this time, the latched counting value is referred to as a second test value. The detection circuit 172 compares the abnormal value and the second test value. At this time, if the second test value is less than the abnormal value, this means that no exceptional events have occurred in the pin transmitting the segment signal $SEG_1$. Therefore, the switching circuit 152 may not change the common signals $COM_1$~$COM_7$ and set the segment signals $SEG_0$~$SEG_2$ to change between voltages V0 and V3. However, if the second test value is not less than the abnormal value, this means that the pin transmitting the segment signal $SEG_1$ causes an overload. Therefore, the detection circuit 172 may store the current reset result. The tester can quickly find the reason for the overload based on the stored test results.

In the test mode, each time the image driving circuit 132 outputs the common signals $COM_0$~$COM_7$ and the segment signals $SEG_0$~$SEG_{43}$, the detection circuit 172 determines whether the overload disappears. When the overload disappears, this means that the load of the display panel is normal. Therefore, the problematic signal among the common signals $COM_0$~$COM_7$, the segment signals $SEG_0$~$SEG_{43}$, and the voltages V0~V3 can be found. The problematic pin of the display panel 110 can be also found.

In one embodiment, the image driving circuit 132 asserts the voltages V1~V3, the common signals $COM_0$~$COM_7$ and the segment signals $SEG_0$~$SEG_{43}$ continuously. Each time one voltage/signal is asserted, the detection circuit 172 determines whether the overload disappears. In other embodiments, the image driving circuit 132 continuously asserts the common signals $COM_0$~$COM_7$, the segment signals $SEG_0$~$SEG_{43}$, and the voltages V1~V3.

Figure 4:
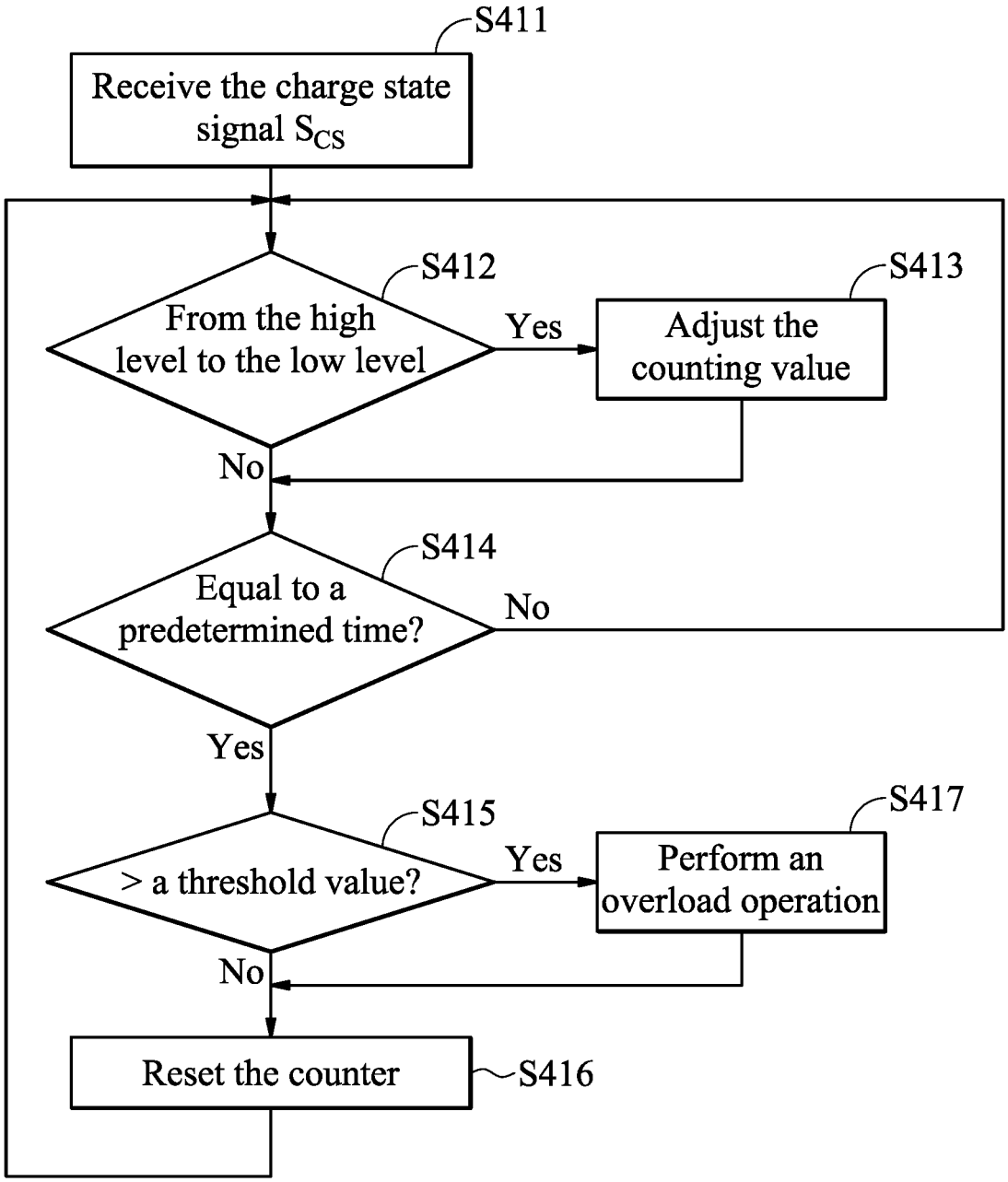
FIG. 4 is a schematic diagram of an exemplary embodiment of the operation flow of a loading management circuit, according to various aspects of the present disclosure.

FIG. 4 is a schematic diagram of an exemplary embodiment of the operation flow of the loading management circuit 134, according to various aspects of the present disclosure. First, the charge state signal $S_{CS}$ is received (step S411). In one embodiment, the charge state signal $S_{CS}$ is the charging signal $S_{CHR}$. In such cases, when the charge state signal $S_{CS}$ is at a high level, this means that the charging circuit 133 is charging the continuously the capacitor 120. When the charge state signal $S_{CS}$ is at a low level, this means that the charging circuit 133 stops charging the capacitor 120.

Next, a determination is made as to whether the voltage level of charge state signal $S_{CS}$ has changed from the high level to the low level (step S412). When the voltage level of charge state signal $S_{CS}$ has changed from the high level to the low level, the counting value of the counter 171 is adjusted (step S413). In one embodiment, the counter 171 is a count-up counter. In such cases, the counting value is increased in step S413. In another embodiment, the counter 171 is a count-down counter. In such cases, the counting value is reduced in step S413.

When the voltage level of charge state signal $S_{CS}$ is not changed from the high level to the low level, a determination is made as to whether it has timed to a predetermined time (step S414). The duration of the predetermined time may be the duration of period $T_1$ shown in FIG. 2 or the duration of period 311 shown in FIG. 2. If it has not timed to the predetermined time, step S412 is performed. If it has timed to the predetermined time, a determination is made as to whether the counting value is higher than a threshold value (step S415). If the counting value is not higher than the threshold value, the counter is reset (step S416) and then step S412 is performed again.

However, if the counting value is higher than the threshold value, this indicates the occurrence of an overload. Therefore, an overload operation is performed (step S417). In one embodiment, the overload operation is to assert the flag 135. In such cases, the image driving circuit 132 enters a test mode according to the flag 135. In another embodiment, the overload operation is to send a notification signal $S_{NT}$ to direct the image driving circuit 132 to enter the test mode. In the test mode, the image driving circuit 132 generates the test signal $S_T$. The image driving circuit 132 provides the test signal $S_T$ to the display panel.

Then, the counting value of the counter 171 is reset (step S416) and step S412 is performed to count the number of pulses of the charge state signal $S_{CS}$ which is used to determine whether there has been an overload.

Figure 5:
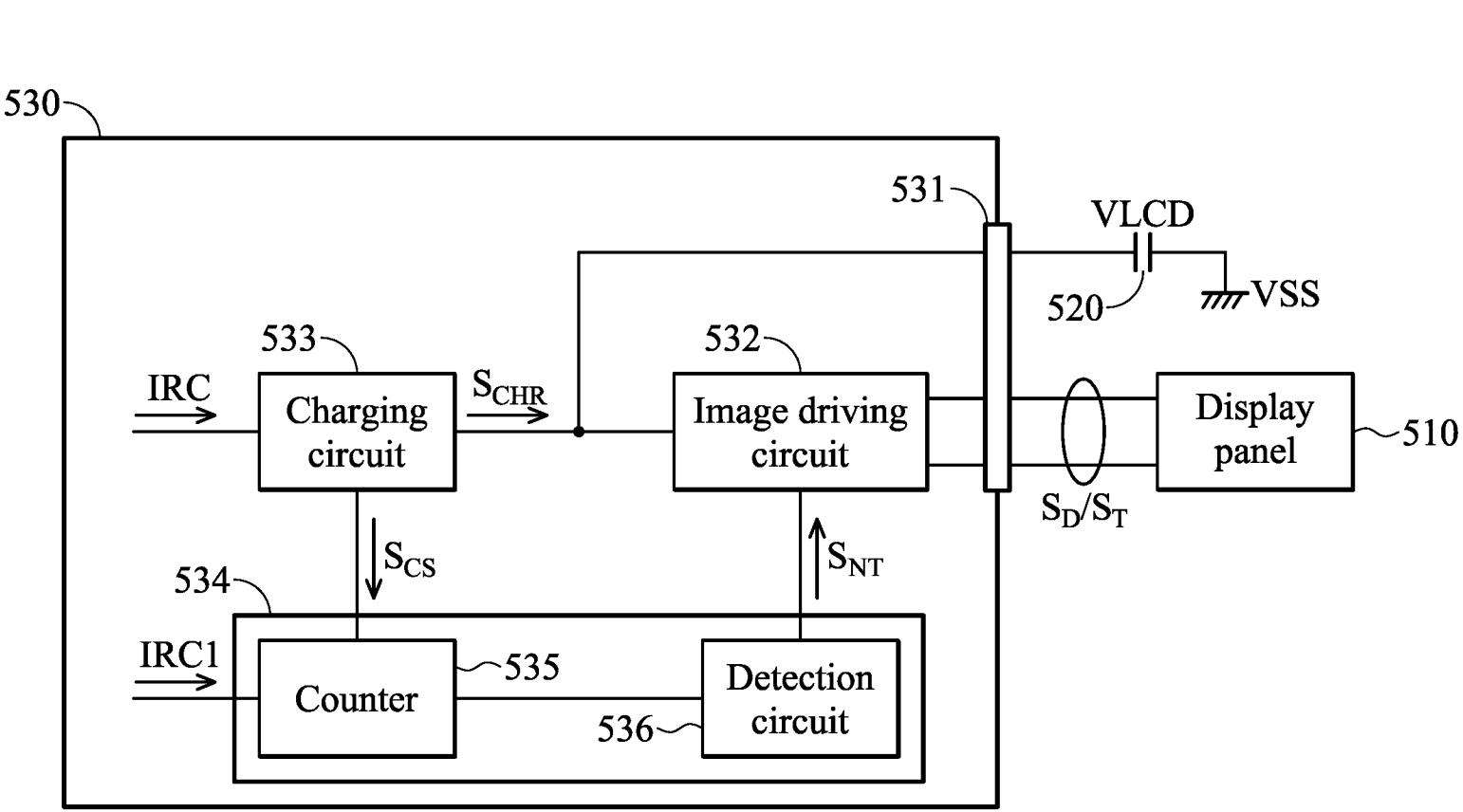
FIG. 5 is a schematic diagram of another exemplary embodiment of the control circuit, according to various aspects of the present disclosure.

FIG. 5 is a schematic diagram of another exemplary embodiment of the control circuit, according to various aspects of the present disclosure. FIG. 5 is similar to FIG. 2 with the exception that the load management circuit 534 of FIG. 5 obtains how long it took for the charging circuit 533 to stabilize the voltage VLCD provided by the capacitor 520 at a target value according to the duration of the charge state signal $S_{CS}$ being at a specific level (e.g., a high level). When the charge time of the capacitor 520 exceeds a threshold value, this marks the occurrence of an overload.

In this embodiment, the charge state signal $S_{CS}$ is provided by the charging circuit 533. When the charging circuit 533 charges the capacitor 520, the charging circuit 533 generates the charge state signal $S_{CS}$. When the charge state signal $S_{CS}$ is at a specific level for too long, this marks the occurrence of an overload. The structure of the load management circuit 534 is not limited in the present disclosure. In this embodiment, the load management circuit 534 comprises a counter 535 and a detection circuit 536.

The counter 535 calculates the duration of the charge state signal $S_{CS}$ being at the specific level. In one embodiment, when the charge state signal $S_{CS}$ changes from a low level to a high level, the counter 535 resets its counting value so that the counting value is equal to its initial value, which may be "0". The counter 535 starts counting according to the clock signal IRC1 until the charge state signal $S_{CS}$ changes from the high level to the low level. In one embodiment, when the charge state signal $S_{CS}$ is at the high level, the counter 535 counts the number of pulses of the clock signal IRC1.

When the charge state signal $S_{CS}$ changes from the high level to the low level, the counter 535 latches its counting value. In such cases, the counting value of the counter 535 is referred to as a latch value. The detection circuit 536 determines whether the latch value is greater than a predetermined number. If the latch value is greater than the predetermined number, this means that the charge time of the capacitor 520 exceeds a threshold value. Therefore, the detection circuit 536 asserts a flag (not shown) or sends a notification signal $S_{NT}$ to notify the image driving circuit 532 of an overload. Therefore, the image driving circuit 532 enters a test mode.

Since the characteristics of the transmission interface 531, the image driving circuit 532, and the charging circuit 533 shown in FIG. 5 are similar to the characteristics of the transmission interface 131, the image driving circuit 132, and the charging circuit 133 shown in FIG. 2, the related description is omitted here. Additionally, since the characteristics of the display panel 510 and the capacitor 520 shown in FIG. 5 are similar to the characteristics of the display panel 110 and the capacitor 120 shown in FIG. 1, the related description is omitted here.

Figure 6:
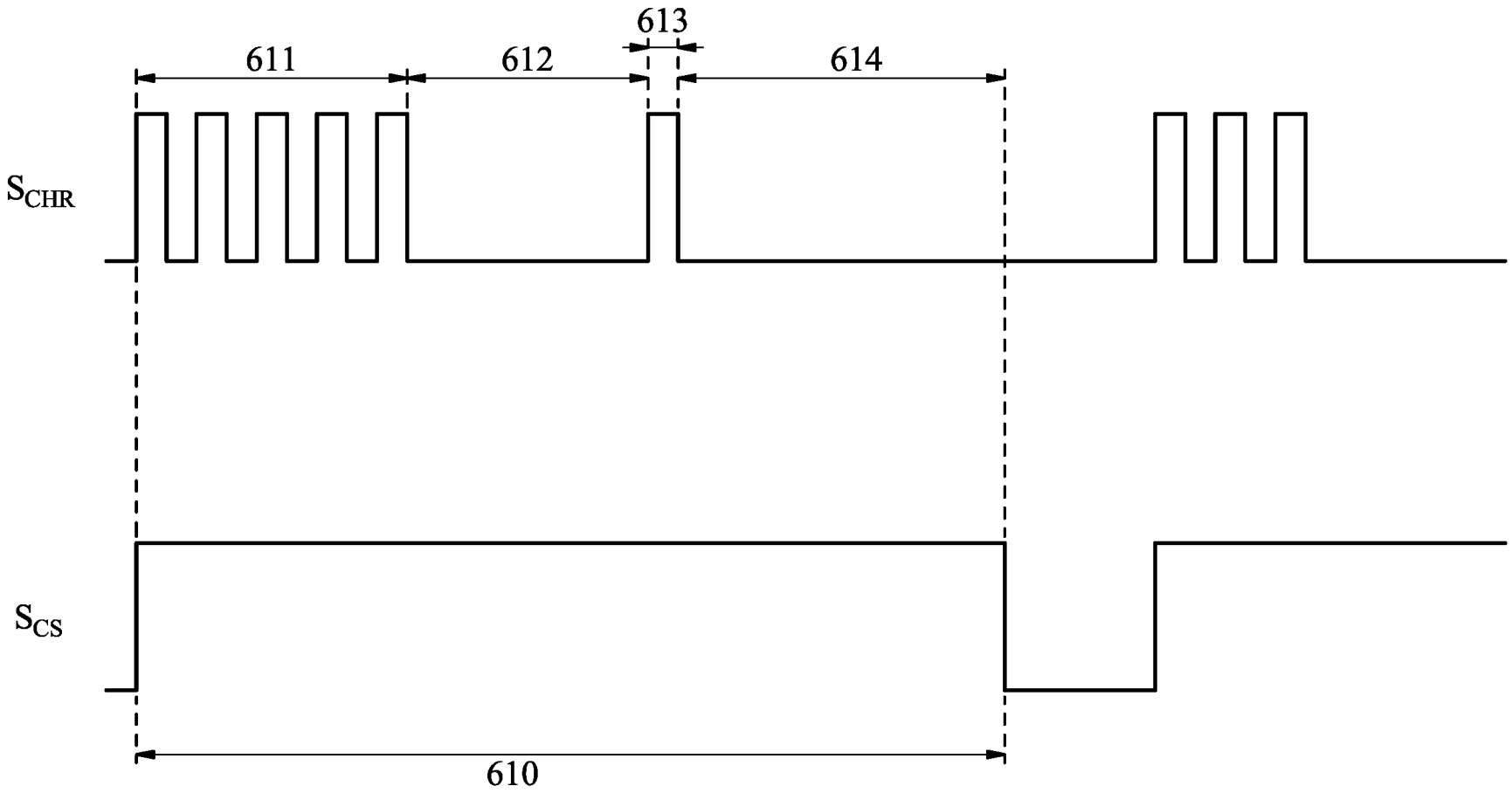
FIG. 6 is a schematic diagram of an exemplary embodiment of a charging state signal, according to various aspects of the present disclosure.

FIG. 6 is a schematic diagram of an exemplary embodiment of the charging state signal $S_{CS}$, according to various aspects of the present disclosure. Taking FIG. 3 as an example, when the voltage of the common signal $COM_0$ changes, such as from voltage V3 to voltage V0, the voltage VLCD of the capacitor 520 is reduced immediately. At this time, since the voltage VLCD is not equal to the target value, the charging circuit 533 generates a charging signal $S_{CHR}$ and provides it to the capacitor 520.

As shown in FIG. 6, in period 611, the charging circuit 533 generates a plurality of charging pulses to charge the capacitor 520. Since the charging circuit 533 starts to charge the capacitor 520, the charging circuit 533 sets the charge state signal $S_{CS}$ at a high level. At this time, the counter 535 starts counting.

In period 612, the charging circuit 533 stops generating the charging pulses so that the charging signal $S_{CHR}$ is at a low level. Since the duration of the charging signal $S_{CHR}$ being at the low level is less than a predetermined vale (e.g., 0.3 sec), the charging circuit 533 maintains the charge state signal $S_{CS}$ at the high level.

In period 613, since the voltage VLCD of the capacitor 520 is less than the target value, the charging circuit 533 provides the charging pulses again to charge the capacitor 520. At this time, the charge state signal $S_{CS}$ is still maintained at the high level. In period 614, the charging circuit 533 stops charging the capacitor 520, and the duration of the charging signal $S_{CHR}$ being at the low level reaches the predetermined value (e.g., 0.3 sec), the charge state signal $S_{CS}$ changes from the high level to the low level.

In this embodiment, the detection circuit 536 times the duration 610 of the charge state signal $S_{CS}$ being at the high level to determine whether the charge time of the capacitor 520 is too long. When the duration 610 is too long, this means that an overload may occur. The overload causes the charging circuit 533 to continuously charge the capacitor 520. Therefore, the detection circuit 530 notifies the image driving circuit 532.

Figure 7:
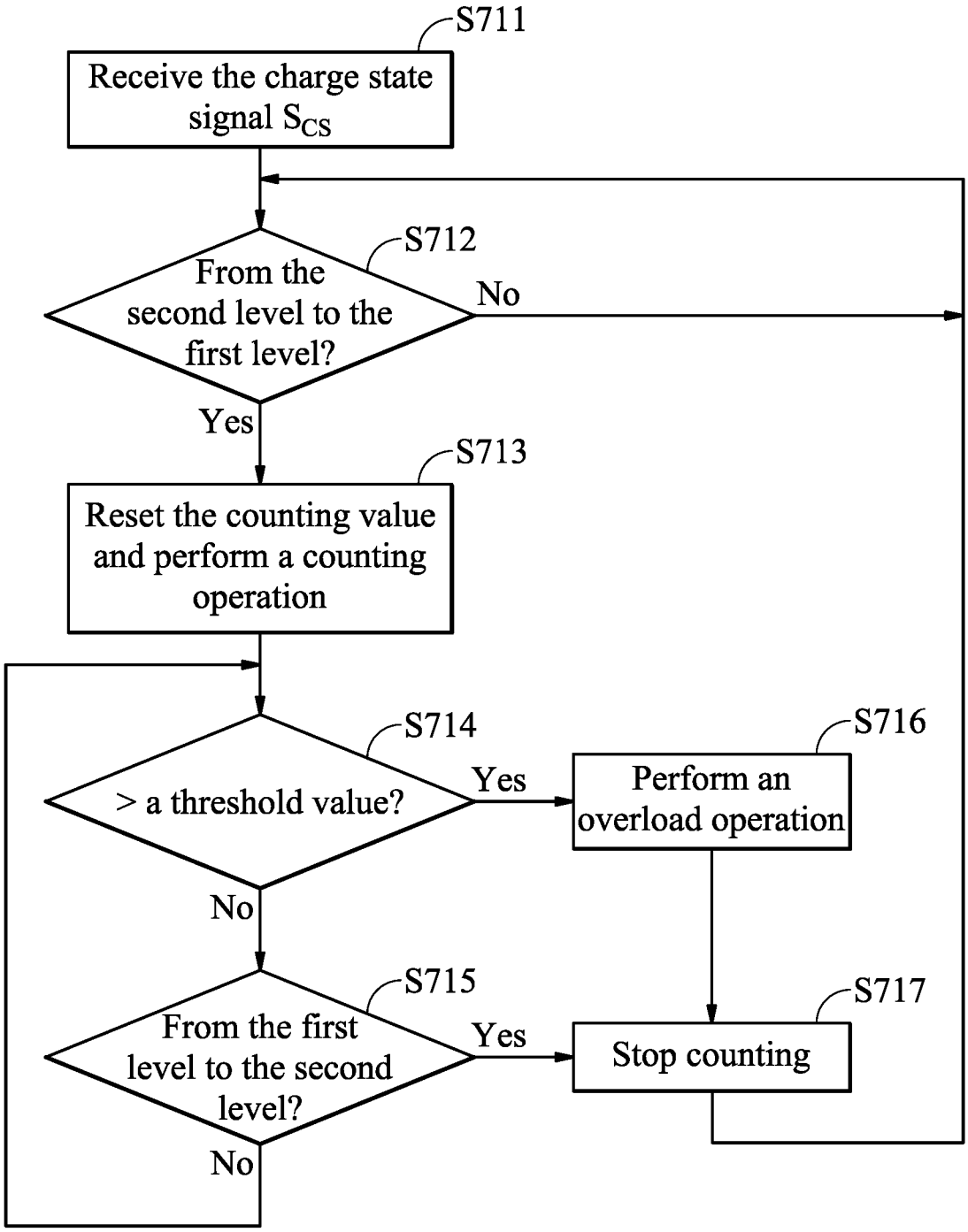
FIG. 7 is a flowchart of an exemplary embodiment of the loading management circuit of FIG. 5, according to various aspects of the present disclosure.

FIG. 7 is a flowchart of an exemplary embodiment of the operation of the loading management circuit 534 of FIG. 5, according to various aspects of the present disclosure. First, the charge state signal $S_{CS}$ is received (step S711). In one embodiment, when the charging circuit 533 charges the capacitor 520, the charging circuit 533 generates the charge state signal $S_{CS}$. In such cases, the charge state signal $S_{CS}$ indicates the charge time of the capacitor 520. In one embodiment, when the charge state signal $S_{CS}$ is at a first level, this means that the voltage VLCD of the capacitor 520 is not enough. Therefore, the charging circuit 533 charges the capacitor 520. When the charge state signal $S_{CS}$ is at a second level, this means that the voltage VLCD of the capacitor 520 is enough. Therefore, the charging circuit 533 stops charging the capacitor 520. In this embodiment, the first level is opposite to the second level. For example, when the first level is a high level, the second level is a low level. When the first level is a low level, the second level is a high level.

Next, a determination is made as to whether the charge state signal $S_{CS}$ has changed from the second level to the first level (step S712). If the charge state signal $S_{CS}$ has not changed from the second level to the first level, this means that the charging circuit 533 does not start to charge the capacitor 520. Therefore, step S712 is performed again to determine whether the level of the charge state signal $S_{CS}$ has changed. If the charge state signal $S_{CS}$ has changed from the second level to the first level, this means that the charging circuit 533 starts to charge the capacitor 520. Therefore, the counting value is reset and a counting operation is performed based on the clock signal IRC1 (step S713).

A determination is made as to whether the counting value is higher than a threshold value (step S714). When the counting value is not higher than a threshold value, a determination is made as to whether the charge state signal $S_{CS}$ has changed from the first level to the second level (step S715). When the charge state signal $S_{CS}$ has changed from the first level to the second level, this means that the charging circuit 533 stops charging the capacitor 520. Therefore, the counting is stopped (step S717). However, when the charge state signal $S_{CS}$ has not changed from the first level to the second level, this means that the charging circuit 533 is still charging the capacitor 520. Therefore, step S714 is performed to determine whether the counting value is higher than a threshold value.

When the counting value is higher than a threshold value, this indicates the occurrence of an overload. Therefore, an overload operation is performed (step S716). In one embodiment, the overload operation is to assert a flag to direct the image driving circuit 532 to enter a test mode. In another embodiment, the overload operation sends a notification signal to the image driving circuit 532. Then, counting is stopped (step S717). At this time, the image driving circuit 532 enters the test mode to generate test signals and send them to the display panel 510.

In the test mode, the load management circuit 534 still determines whether an overload is still occurring according to the charge time of the capacitor 520. The load management circuit 534 uses the determined result as a test result. The tester can quickly find the cause of the overload according to the test result stored in the load management circuit 534, to speed up the test.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. It will be understood that although the terms "first," "second," etc. may be used herein to describe various elements, these elements should not be limited by these terms. These terms are only used to distinguish one element from another.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). For example, it should be understood that the system, device and method may be realized in software, hardware, firmware, or any combination thereof. Therefore, the scope of the appended claims should be accorded the broadest interpretation so as to encompass all such modifications and similar arrangements.

What is claimed is:

1. A control circuit for driving a display panel and comprising:

a transmission interface configured to be coupled to the display panel;

a charging circuit providing a charging signal to charge a capacitor;

an image driving circuit, transforming the voltage of the capacitor into a plurality of driving signals and providing the driving signals to the display panel via the transmission interface; and a loading management circuit, measuring a charge time of the capacitor according to the charging signal, wherein:

in response to the charge time of the capacitor exceeding a threshold value, the loading management circuit asserts a flag to indicate an occurrence of an overload, and the loading management circuit obtains the charge time of the capacitor according to the number of pulses of the charging signal in a predetermined time or the duration of the charging signal being at a specific level in the predetermined time, in response to the flag being asserted:

the image driving circuit generates a test signal and provides the test signal to the display panel via at least one first pin of the transmission interface, the load management circuit determines whether the charge time of the capacitor exceeds the threshold value, in response to the charge time of the capacitor exceeding the threshold value, it is determined that the first pin causes the overload, and in response to the charge time of the capacitor not exceeding the threshold value, the image driving circuit provides the test signal to the display panel via at least one second pin of the transmission interface.

2. The control circuit as claimed in claim 1, wherein the capacitor is disposed outside of the control circuit.

3. The control circuit as claimed in claim 2, wherein the charging circuit provides the charging signal to the capacitor via the transmission interface to charge the capacitor.

4. The control circuit as claimed in claim 1, wherein:

in response to the charge time of the capacitor exceeding the threshold value, the loading management circuit generates a notification to direct the image driving circuit to enter a test mode, and in the test mode, the image driving circuit generates a plurality of first test signals and provides the first test signals to the display panel via the transmission interface.

5. The control circuit as claimed in claim 4, wherein:

in response to the charge time of the capacitor exceeding the threshold value, the loading management circuit uses the charge time of the capacitor as an abnormal value, in the test mode, the loading management circuit measures the charge time of the capacitor to generate a test value, and in response to the abnormal value exceeding the test value, the image driving circuit generates a plurality of second test signals and provides the second test signals to the display panel via the transmission interface.

6. The control circuit as claimed in claim 1, wherein the charging circuit comprises:

a charge pump, generating the charging signal to charge the capacitor; and a comparator circuit, configured to determine whether the voltage of the capacitor is less than a target value, wherein in response to the capacitor being less than the target value, the comparator circuit activates the charge pump to direct the charge pump to charge the capacitor.

7. The control circuit as claimed in claim 6, wherein the charge signal comprises a plurality of pulses, the loading management circuit counts the number of pulses in the predetermined time and determines whether the charge time of the capacitor exceeds the threshold value based on the number of pulses in the predetermined time.

8. The control circuit as claimed in claim 6, wherein a specific driving signal among the driving signals changes from a first voltage to a second voltage, remains at the second voltage for the predetermined time, and then changes from the second voltage to a third voltage.

9. The control circuit as claimed in claim 6, wherein:

in a first period, the change of the voltage of a specific signal among the driving signals forms a first pattern, in a second period, the change of the voltage of the specific signal forms a second pattern, the duration of the first period is equal to the duration of the second period, and the first period is adjacent to the second period, and the first pattern is the same as the second pattern, and the predetermined time is equal to the duration of the first period.

10. The control circuit as claimed in claim 1, wherein:

in response to the voltage of the capacitor being less than a target value, the charging circuit charges the capacitor and sets a state signal at a first level, in response to the voltage of the capacitor reaching the target value, the charging circuit sets the state signal at a second level, in response to the state signal being at the first level, the loading management circuit counts the number of pulses of a clock signal, and in response to the number of pulses of the clock signal exceeding a predetermined number, the loading management circuit asserts the flag.

11. A display device comprising:

a display panel;

a capacitor; and a control circuit comprising:

a transmission interface configured to be coupled to the display panel;

a charging circuit providing a charging signal to charge the capacitor;

an image driving circuit, transforming the voltage of the capacitor into a plurality of driving signals and providing the driving signals to the display panel via the transmission interface; and a loading management circuit, measuring a charge time of the capacitor according to the charging signal, wherein:

in response to the charge time of the capacitor exceeding a threshold value, the loading management circuit asserts a flag to indicate an occurrence of an overload, and the loading management circuit obtains the charge time of the capacitor according to the number of pulses of the charging signal in a predetermined time or the duration of the charging signal being at a specific level in the predetermined time, in response to the flag being asserted:

the image driving circuit generates a test signal and provides the test signal to the display panel via at least one first pin of the transmission interface, the load management circuit determines whether the charge time of the capacitor exceeds the threshold value, in response to the charge time of the capacitor exceeding the threshold value, it is determined that the first pin causes the overload, and in response to the charge time of the capacitor not exceeding the threshold value, the image driving circuit provides the test signal to the display panel via at least one second pin of the transmission interface.

12. The display device as claimed in claim 11, wherein the display panel is a twisted nematic (TN) LCD panel or a super-twisted nematic (STN) LCD panel.

13. The display device as claimed in claim 12, wherein the charging circuit provides the charging signal to the capacitor via the transmission interface to charge the capacitor.

14. The display device as claimed in claim 11, wherein:

in response to the charge time of the capacitor exceeding the threshold value, the loading management circuit generates a notification to direct the image driving circuit to enter a test mode, and in the test mode, the image driving circuit generates a plurality of first test signals and provides the first test signals to the display panel via the transmission interface.

15. The display device as claimed in claim 14, wherein:

in response to the charge time of the capacitor exceeding the threshold value, the loading management circuit uses the charge time of the capacitor as an abnormal value, in the test mode, the loading management circuit measures the charge time of the capacitor to generate a test value, and in response to the abnormal value exceeding the test value, the image driving circuit generates a plurality of second test signals and provides the second test signals to the display panel via the transmission interface.

16. The display device as claimed in claim 11, wherein the charging circuit comprises:

a charge pump generating the charging signal to charge the capacitor; and a comparator circuit configured to determine whether the voltage of the capacitor is less than a target value, wherein in response to the capacitor being less than the target value, the comparator circuit enables the charge pump so that the charge pump charges the capacitor.

17. The display device as claimed in claim 16, wherein the charge signal comprises a plurality of pulses, the loading management circuit counts the number of pulses in the predetermined time and determines whether the charge time of the capacitor exceeds the threshold value based on the number of pulses in the predetermined time.

18. The display device as claimed in claim 16, wherein a specific driving signal among the driving signals changes from a first voltage to a second voltage, remains at the second voltage for the predetermined time, and then changes from the second voltage to a third voltage.

19. The display device as claimed in claim 16, wherein:

in a first period, the change of the voltage of a specific signal among the driving signals forms a first pattern, in a second period, the change of the voltage of the specific signal forms a second pattern, the duration of the first period is equal to the duration of the second period, and the first period is adjacent to the second period, and the first pattern is the same as the second pattern, and the predetermined time is equal to the duration of the first period.

20. The display device as claimed in claim 11, wherein:

in response to the voltage of the capacitor being less than a target value, the charging circuit charges the capacitor and sets a state signal at a first level, in response to the voltage of the capacitor reaching the target value, the charging circuit sets the state signal at a second level, in response to the state signal being at the first level, the loading management circuit counts the number of pulses of a clock signal, and in response to the number of pulses of the clock signal exceeding a predetermined number, the loading management circuit asserts the flag.

* * * * *